US009889545B2

(12) United States Patent
Gang

(10) Patent No.: US 9,889,545 B2
(45) Date of Patent: Feb. 13, 2018

(54) PIPE WRENCH ASSEMBLY

(71) Applicant: Anil S. Gang, Orange, NJ (US)

(72) Inventor: Anil S. Gang, Orange, NJ (US)

( * ) Notice: Subject to any disclaimer, the term of this patent is extended or adjusted under 35 U.S.C. 154(b) by 373 days.

(21) Appl. No.: 14/627,342

(22) Filed: Feb. 20, 2015

(65) Prior Publication Data

US 2016/0243682 A1 Aug. 25, 2016

(51) Int. Cl.
*B25B 13/50* (2006.01)
*B25B 13/46* (2006.01)

(52) U.S. Cl.
CPC ..... *B25B 13/5058* (2013.01); *B25B 13/46* (2013.01)

(58) Field of Classification Search
CPC ... B25B 13/463; B25B 13/46; B25B 13/5058; B25B 13/18; B25B 21/004; B25B 13/50; B25B 15/02; B25B 15/04; B25B 13/00; B25B 13/467; B25B 13/5008
See application file for complete search history.

(56) References Cited

U.S. PATENT DOCUMENTS 525,684 A 9/1894 Friede
2,704,479 A * 3/1955 Stang ..... B25B 13/46 81/167
3,097,552 A 7/1963 Kelley
3,122,952 A * 3/1964 Eliason ..... B25B 27/00 81/57.32
4,305,316 A * 12/1981 Lehman ..... B25B 5/003 81/180.1
4,356,743 A * 11/1982 Muschalek, Jr. ..... B25B 13/14 81/180.1
D272,035 S 1/1984 McMillian
4,831,903 A 5/1989 Dausey et al.
4,924,735 A * 5/1990 Lee ..... B25B 13/14 81/133
5,823,076 A 10/1998 Binkowski
6,205,892 B1 3/2001 Davidson
2006/0278047 A1 12/2006 Thompson
2008/0178710 A1 7/2008 Alvardo

* cited by examiner

*Primary Examiner* — Robert Scruggs

(57) ABSTRACT

A pipe wrench assembly includes a pair of pipe grips. A handle has a front end and a rear end. A housing is attached to the front end of the handle and is attached to each of the pipe grips adjacent to the second ends such that one of the pipe grips includes a receiving opening facing in a first direction and another of the pipe grips includes a receiving opening facing in a second direction. A ratchet drive is mounted in the housing and is mechanically coupled to each of the pipe grips such that the housing is rotatable with respect to the pipe grips. The pipe grips are movable in a ratcheting movement opposite of each other.

6 Claims, 5 Drawing Sheets

PIPE WRENCH ASSEMBLY

BACKGROUND OF THE DISCLOSURE

Field of the Disclosure

The disclosure relates to pipe wrench devices and more particularly pertains to a new pipe wrench device for gripping multiple pipes simultaneously.

SUMMARY OF THE DISCLOSURE

An embodiment of the disclosure meets the needs presented above by generally comprising a pair of pipe grips. A handle has a front end and a rear end. A housing is attached to the front end of the handle and is attached to each of the pipe grips adjacent to the second ends such that one of the pipe grips includes a receiving opening facing in a first direction and another of the pipe grips includes a receiving opening facing in a second direction. A ratchet drive is mounted in the housing and is mechanically coupled to each of the pipe grips such that the housing is rotatable with respect to the pipe grips. The pipe grips are movable in a ratcheting movement opposite of each other.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
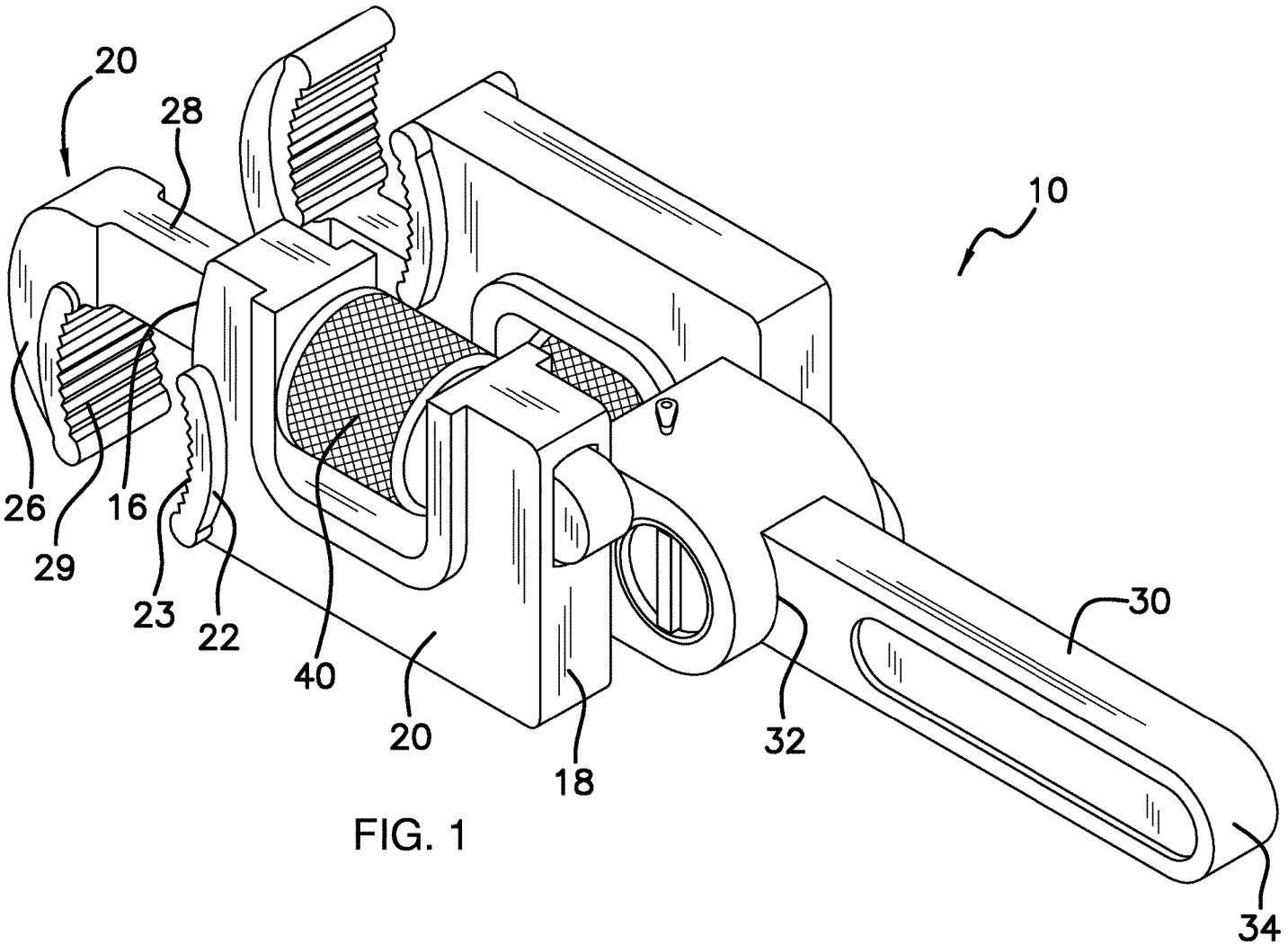
FIG. 1 is a top perspective view of a pipe wrench assembly according to an embodiment of the disclosure.
Figure 2:
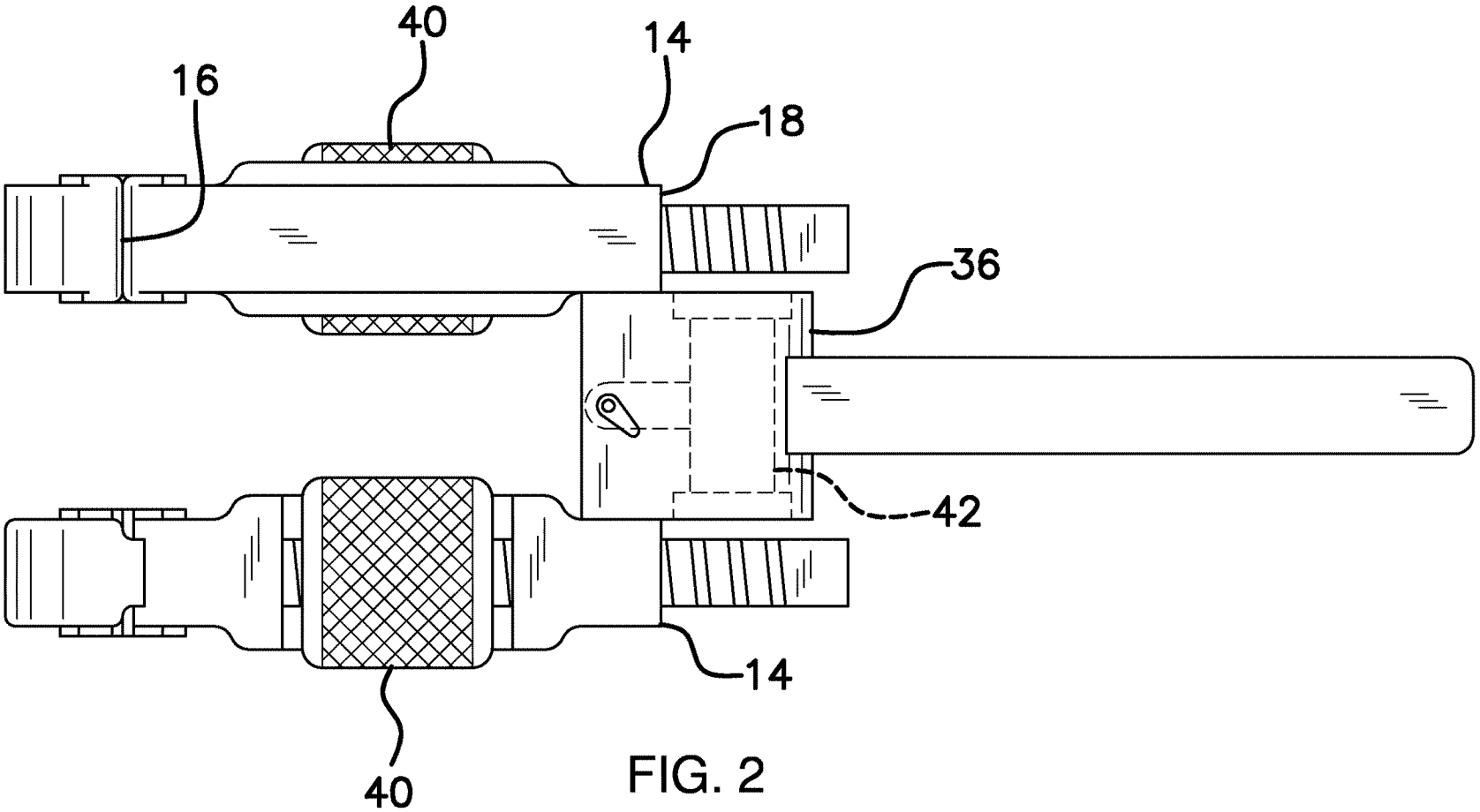
FIG. 2 is a top view of an embodiment of the disclosure.
Figure 3:
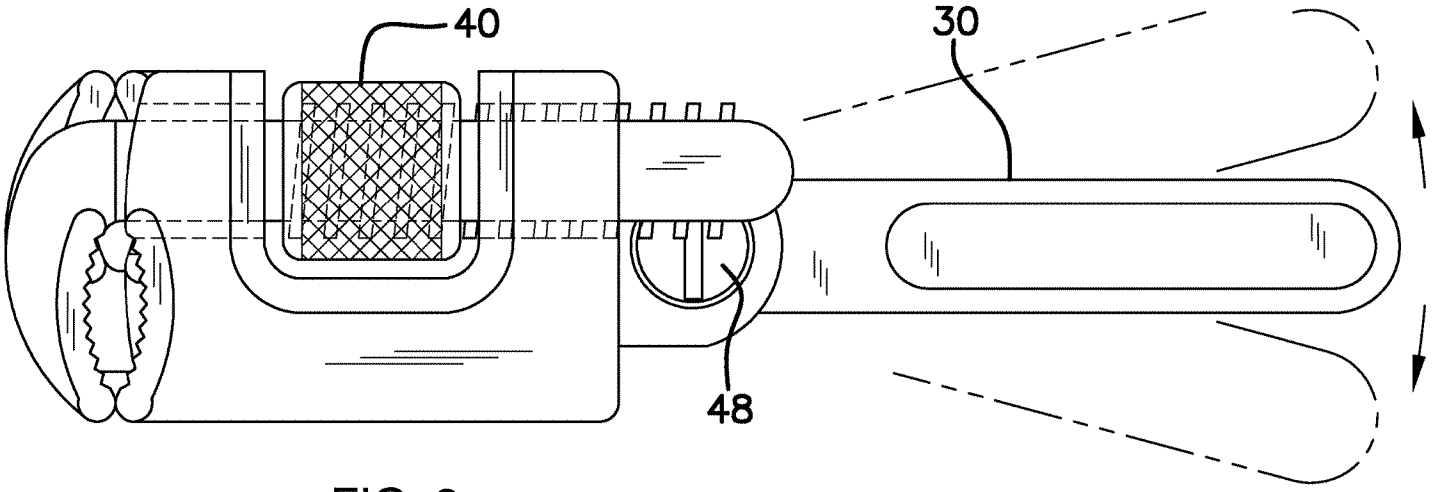
FIG. 3 is a front view of an embodiment of the disclosure.
Figure 4:
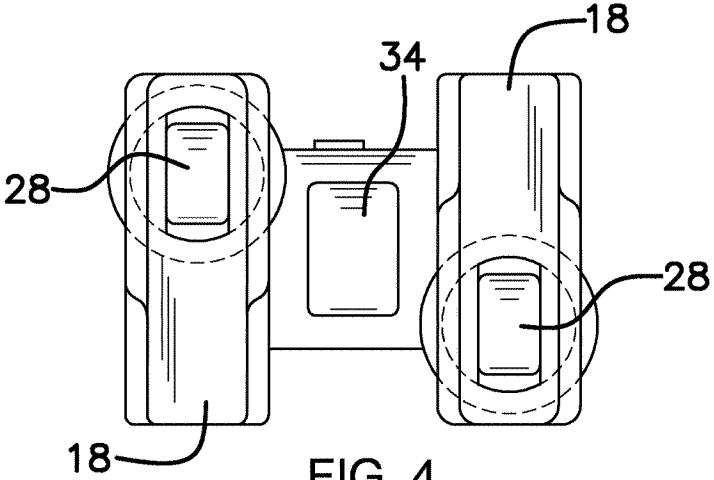
FIG. 4 is a right side view of an embodiment of the disclosure.

With reference now to the drawings, and in particular to FIGS. 1 through 6 thereof, a new pipe wrench device embodying the principles and concepts of an embodiment of the disclosure and generally designated by the reference numeral 10 will be described.

As best illustrated in FIGS. 1 through 6, the pipe wrench assembly 10 generally comprises a pair of pipe grips 12. Each of the pipe grips 12 includes a head 14 having a first end 16, a second end 18 and a perimeter wall 20 that is attached to and extends between the first 16 and second 18 ends. A fixed jaw 22 is attached to the first end 16 and has teeth 23 facing away from the head 14. A movable jaw 24 includes an upper jaw 26 and an arm 28 is attached to and extends away from the upper jaw 26. The arm 28 extends into the first end 16 so that the upper jaw 26 includes teeth 29 facing the teeth 23 of the fixed jaw 22. The fixed jaw 22 and upper jaw 26 may each include concavely arcuate faces facing each other. An actuator 40 is mounted on the head 14 and is mechanically engaged to the arm 28. The actuator 40 is actuated in a first direction to move the movable jaw 24 towards the fixed jaw 22 and a second direction to move the movable jaw 24 away from the fixed jaw 22. The actuator 40 may include a cylinder threadably engaged to the arm 28. Alternate means to move the arm 28 conventional to wrenches may be utilized as well.

A handle 30 has a front end 32 and a rear end 34. The area adjacent to the rear end 32 defines a grip to be held by a user of the assembly 10. A housing 36 is attached to the front end 32 of the handle 30 and is in a fixed positioned relative to the handle 30. Moreover, the handle 30 and the housing 36 may be of unitary construction. The housing 36 is attached to each of the heads 14 adjacent to the second ends 18 such that one of the pipe grips 12 includes a receiving opening 38 facing in a first direction and another of the pipe grips 12 includes a receiving opening 38 facing in a second direction. More particularly, the handle 30 may be horizontally oriented so that one of the receiving openings 38 is directed upwardly while the other one of the receiving openings 38 is directed downwardly.

Figure 5:
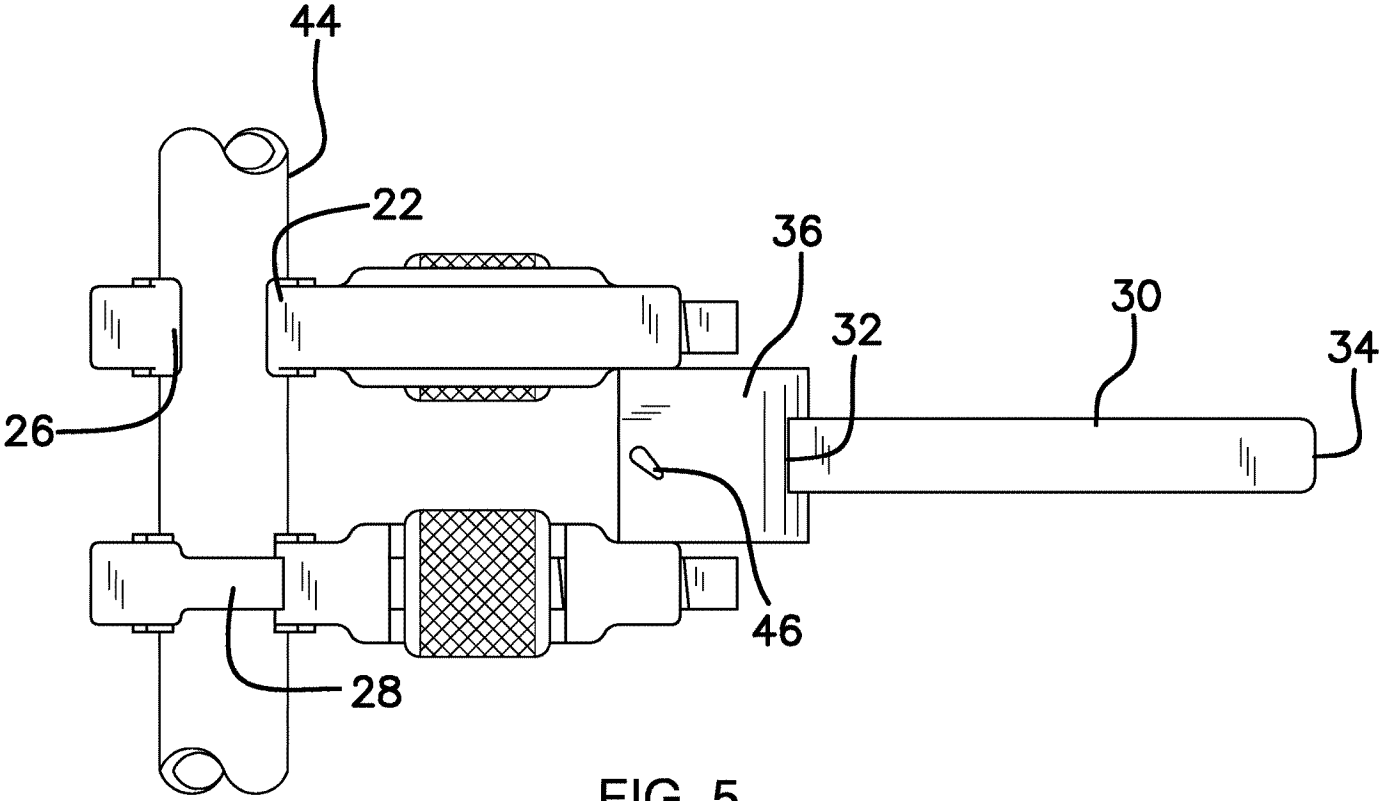
FIG. 5 is a top in-use view of an embodiment of the disclosure.
Figure 6:
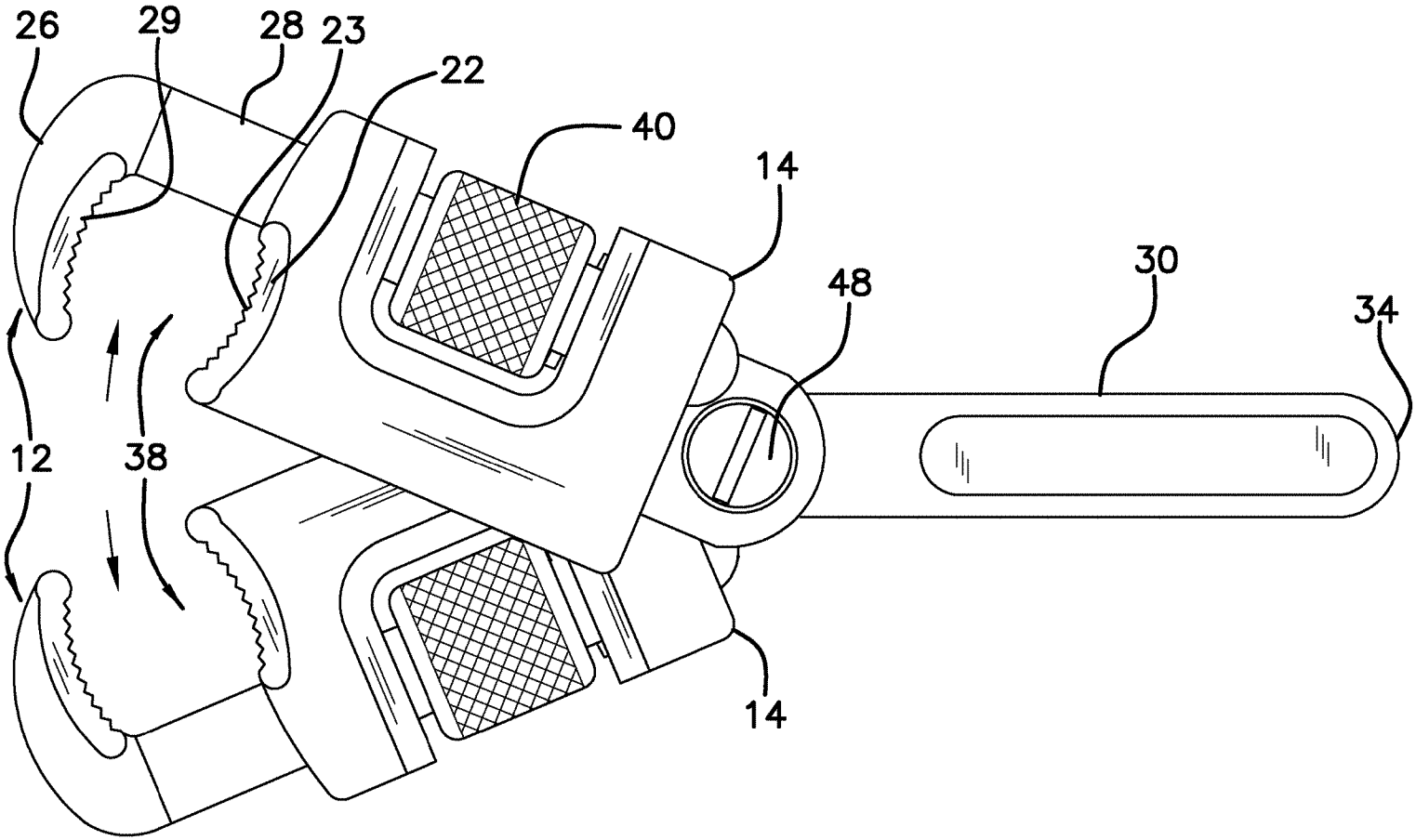
FIG. 6 is a front view of an embodiment of the disclosure.

A conventional ratchet drive 42 is mounted in the housing 36. The ratchet drive 42 is mechanically coupled to each of the heads 14 of the pipe grips 12 such that the housing 36 is rotatable with respect to the pipe grips 12. The pipe grips 12 are movable in a ratcheting movement opposite of each other. Thus, when the handle 30 is turned around a pipe 44 downwardly, one pipe grip 12 will remained fixed relative to the handle 30 while the other one will be allowed to rotate. When the handle 30 is then turned around the pipe 44 upwardly, the previously fixed pipe grip 12 will rotate relative to the handle 30 while the other one will be fixed. This will allow two pipes to be simultaneously mounted onto a T-fitting with the assembly by holding the T-fitting while the handle 30 is moved up and down relative to the T-fitting. The ratchet drive 42 may include a selector 46 to reverse the pipe grip 12 movements so that each of the pipe grips 12 are selectively pivotable in a first direction or a second direction with respect to the housing 36 when the ratchet drive 42 is actuated. Each of the pipe grips 12 may further be mechanically coupled to a lock 48 to selectively lock the pipe grips 12 with respect to the housing 36. This will allow the pipe grips 12 to be used simultaneously with a pipe 44 as shown in FIG. 5.

In use, the assembly 10 is used in a conventional manner with respect to pipe wrenches, however, the ratchet drive 42 allows the user to use two pipe grips 12 that pivot independently and opposite of each other to grip two pipes, simultaneously, and rotate them in opposite directions with respect to each other.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pipe wrench assembly comprising:

a pair of pipe grips, each of said grips including a head having a first end, a second end and a perimeter wall being attached to and extending between said first and second ends;

a handle having a front end and a rear end;

a housing being attached to said front end of said handle, said housing being attached to each of said pipe grips adjacent to said second ends such that one of said pipe grips includes a receiving opening facing in a first direction and another of said pipe grips includes a receiving opening facing in a second direction; and a ratchet drive being mounted in said housing, said ratchet drive being mechanically coupled to each of said pipe grips such that said housing is rotatable with respect to said pipe grips, said pipe grips being movable in a ratcheting movement opposite of each other.

2. The pipe wrench assembly according to claim 1, wherein each of said pipe grips includes:

a fixed jaw being attached to said first end and having teeth facing away from said head;

a movable jaw including an upper jaw and an arm being attached to and extending away from said upper jaw, said arm extending into said first end, said upper jaw including teeth facing said teeth of said fixed jaw; and an actuator being mounted on said head and being mechanically engaged to said arm, said actuator being actuated in a first direction to move said movable jaw towards said fixed jaw and a second direction to move said movable jaw away from said fixed jaw.

3. The pipe wrench assembly according to claim 2, wherein housing is attached to each of said heads adjacent to said second ends.

4. The pipe wrench assembly according to claim 1, wherein said ratchet drive includes a selector wherein each of said pipe grips are selectively pivotable in a first direction or a second direction with respect to said housing when said ratchet drive is actuated.

5. The pipe wrench assembly according to claim 1, wherein each of said first and second grips being mechanically coupled to a lock to selectively lock said pipe grips with respect to said housing.

6. A pipe wrench assembly comprising:

a pair of pipe grips, each of said pipe grips including:

a head having a first end, a second end and a perimeter wall being attached to and extending between said first and second ends;

a fixed jaw being attached to said first end and having teeth facing away from said head;

a movable jaw including an upper jaw and an arm being attached to and extending away from said upper jaw, said arm extending into said first end, said upper jaw including teeth facing said teeth of said fixed jaw;

an actuator being mounted on said head and being mechanically engaged to said arm, said actuator being actuated in a first direction to move said movable jaw towards said fixed jaw and a second direction to move said movable jaw away from said fixed jaw;

a handle having a front end and a rear end;

a housing being attached to said front end of said handle, said housing being attached to each of said heads adjacent to said second ends such that one of said pipe grips includes a receiving opening facing in a first direction and another of said pipe grips includes a receiving opening facing in a second direction; and a ratchet drive being mounted in said housing, said ratchet drive being mechanically coupled to each of said heads of said pipe grips such that said housing is rotatable with respect to said pipe grips, said pipe grips being movable in a ratcheting movement opposite of each other, said ratchet drive including a selector wherein each of said pipe grips are selectively pivotable in a first direction or a second direction with respect to said housing when said ratchet drive is actuated, each of said pipe grips being mechanically coupled to a lock to selectively lock said pipe grips with respect to said housing.

* * * * *